US008869897B2

(12) United States Patent
Al-Tahini

(10) Patent No.: US 8,869,897 B2
(45) **Date of Patent: *Oct. 28, 2014**

(54) SAND PRODUCTION CONTROL THROUGH THE USE OF MAGNETIC FORCES

(71) Applicant: Saudi Arabian Oil Company, Dhahran (SA)

(72) Inventor: Ashraf Al-Tahini, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 14/293,702

(22) Filed: Jun. 2, 2014

(65) Prior Publication Data

US 2014/0262248 A1 Sep. 18, 2014

Related U.S. Application Data

(63) Continuation-in-part of application No. 12/773,380, filed on May 4, 2010, now Pat. No. 8,776,883.

(51) Int. Cl.
*E21B 43/16* (2006.01)
*E21B 43/02* (2006.01)

(52) U.S. Cl.
CPC ..... *E21B 43/025* (2013.01)
USPC ..... 166/305.1; 166/369; 166/66.5

(58) Field of Classification Search
USPC ..... 166/279, 310, 66.5, 248, 250.01, 307, 166/305.1, 369, 276
See application file for complete search history.

(56) References Cited

U.S. PATENT DOCUMENTS

| | | | | |
|---|---|---|---|---|
| 4,378,845 | A | 4/1983 | Medlin et al. | |
| 4,579,173 | A * | 4/1986 | Rosensweig et al. | 166/248 |
| 4,802,534 | A | 2/1989 | Larson et al. | |
| 4,834,898 | A * | 5/1989 | Hwang | 252/62.56 |

(Continued)

FOREIGN PATENT DOCUMENTS

| | | |
|---|---|---|
| RU | 2276259 C2 | 5/2006 |
| SU | 377504 | 10/1970 |
| SU | 874990 | 2/1980 |

OTHER PUBLICATIONS

International Search Report with Written Opinion issued in related PCT Patent Application No. PCT/US2011/034296; dated Jul. 5, 2012; 11 pages.

*Primary Examiner* — Jennifer H Gay
*Assistant Examiner* — Taras P Bemko
(74) *Attorney, Agent, or Firm* — Bracewell & Giuliani LLP; Constance G. Rhebergen; James M. Sellers

(57) ABSTRACT

A method for preventing the production and formation of loose sand particles during production of a production fluid includes converting in the production zone both a loose sand particle into a magnetized loose sand particle and a cemented sand particle into a magnetized cemented sand particle. The method includes introducing a magnetic source into a wellbore. The method includes operating the magnetic source such that a continuous magnetic field is generated and the continuous repulsive magnetic force is less than the mean cementation strength. The method includes producing the production fluid from the production zone to the wellbore at a production rate. The method includes maintaining the magnetic source and the production rate of the hydrocarbon fluid such that within the distance from the magnetic source the production fluid drag force is less than or equal to the continuous repulsive magnetic force.

20 Claims, 3 Drawing Sheets

(56) References Cited

U.S. PATENT DOCUMENTS

| | | | | |
|---|---|---|---|---|
| 5,386,875 | A | 2/1995 | Venditto et al. | |
| 5,443,119 | A | 8/1995 | Chambers et al. | |
| 5,465,789 | A * | 11/1995 | Evans | 166/248 |
| 5,772,877 | A | 6/1998 | Dvorchik et al. | |
| 6,250,848 | B1 | 6/2001 | Moridis et al. | |
| 6,733,668 | B2 | 5/2004 | Pedersen et al. | |
| 7,032,670 | B2 | 4/2006 | Zitha | |
| 7,174,957 | B1 * | 2/2007 | Jokhio | 166/99 |
| 2003/0168216 | A1 * | 9/2003 | Nicholson | 166/297 |
| 2006/0037755 | A1 | 2/2006 | Knobloch | |
| 2006/0185849 | A1 | 8/2006 | Edwards et al. | |
| 2007/0044960 | A1 * | 3/2007 | Lovell et al. | 166/250.07 |
| 2008/0283243 | A1 * | 11/2008 | Rediger et al. | 166/276 |
| 2009/0301718 | A1 | 12/2009 | Baser et al. | |

* cited by examiner

SAND PRODUCTION CONTROL THROUGH THE USE OF MAGNETIC FORCES

CROSS-REFERENCE TO RELATED APPLICATIONS

This patent application is a continuation-in-part application of U.S. Pat. No. 8,776,883, issued Jul. 15, 2014. For purposes of United States patent practice, this application incorporates the contents of the prior Patents and Applications by reference in their entirety.

BACKGROUND OF THE INVENTION

1. Field of the Invention

The field of invention relates to controlling sand production from an underground formation. More specifically, the field relates to a method for controlling loose sand particles and preventing the formation of new loose sand particles before and during production fluid production from an underground formation.

2. Description of the Related Art

During formation of the wellbore, the radial area surrounding the wellbore is exposed to high tangential stresses as the drilling operation traverses the underground formation. As the wellbore wall forms, which defines the wellbore, the high tangential stresses as the bit penetrates the underground formation pass into unconsolidated or poorly consolidated formations. Cemented sand particles are sand particles that are attached through a cementation strength to one another or to parts of the underground formation. The cementation strength between particles and a particle and the remainder of the formation can vary depending on many natural factors. Cemented sand particles are not mobile. The force that is transferred through the underground formation overcomes some of the cementation strengths, resulting in some of the cemented sand particles coming free and forming loose sand particles. The loose sand particles are operable to move about within the underground formation with the movement of the production fluid—a suspension of sand particles within the hydrocarbon and formation water or briny fluid.

A typical hydrocarbon-producing wellbore includes a production zone from which the production fluid is produced. The production fluid is conveyed to the surface through a production string. At locations along the production string, small perforations allow the produced production fluid to enter the production string from the wellbore. During production, loose sand particles enter the wellbore, into the production string through the perforations and are conveyed to the surface. Collecting sand during production of production fluid at the surface is called "sand production", which is undesirable.

In addition to movement of loose sand particles, the flow of the hydrocarbons and water through the production zone generates a production fluid drag force. The production fluid drag force can create additional loose sand particles. The production fluid drag force increases with increasing fluid velocity of the production fluid moving through the production zone. The production fluid drag force, when sufficient, can overcome the cementation strength of a cemented sand particle, dislodging the particle from the production zone and forming a new loose sand particle. The new loose sand particles are mobile and move with the production fluid similar to the originally-formed loose sand particles. To avoid this situation, production fluid is often produced at a production rate lower than desired to prevent the inflow of new sand, which may clog downhole equipment and damage rotational surface equipment. The new loose sand particle may also damage the production zone by clogging pores close to the wellbore and preventing the flow of production fluid.

During the initiation of production, the production fluid drag force can cause severe sand production in unconsolidated or poorly consolidated sandstone hydrocarbon-bearing formations. Sand production is often triggered at the initial time of production ($t=t_0$) as all of the loose sand particles and some of the more weekly cemented sand particles are influenced by the production fluid flowing into the wellbore. The sand production initially can be heavy if the production fluid drag force exceeds the mean cementation strength of the sand particles in the production zone as individual sand particles break free of the production zone or larger sand particle clusters disintegrate.

At the start of production from the production zone at $t_0$, the production zone experiences the production fluid drag force for the first time. In some instances, sand production decreases with time ($t>t_0$) as steady state at the production rate is achieved and the production fluid drag force is less than the mean cementation strength for the remaining cemented sand particles. In such an instance, new loose sand particles are not generated from the production zone. In other instances, sand production increases with time after $t_0$. The steady state production rate produces a production fluid drag force that exceeds the mean cementation strength of the production zone. In other instances, degradation of the hydrocarbon-bearing formation due to physical erosion or chemical attack can cause the mean cementation strength of the cemented sand particles to be diminished, therefore lowering the permissible production fluid drag force without causing an increase in sand production from the production zone.

In order to limit sand from reaching the surface, various mechanical methods are employed for preventing sand produced from an underground formation from entering the production stream. Gravel packs, sand screens, standalone perforated or slotted lines and expandable sand screens are all operable to control the loose sand particles inside a wellbore; however, over time with continued sand production from the production zone the particles accumulate in the wellbore. The accumulated sand causes gradual tool failure due to erosion and increased pressure differential between the production zone and the surface, which requires additional energy to move the production fluid or downtime to permit the production zone to pressurize.

There is a need for a method of controlling the production of sand when producing from a poorly consolidated underground formation that (1) allows for longer run times, (2) does not result in increased pressure differentials, (3) does not lead to premature tool failure and (4) does not lead to additional loose sand production during production from the production zone.

SUMMARY OF THE INVENTION

A method for preventing the production and formation of loose sand particles from a production zone of an underground formation during production of a production fluid includes the step of converting in the production zone both a loose sand particle into a magnetized loose sand particle and a cemented sand particle into a magnetized cemented sand particle. The production zone includes the loose sand particle, the cemented sand particle and the production fluid. The cemented sand particle has a mean cementation strength to the production zone. The method includes introducing a magnetic source into a wellbore such that the magnetic source is located proximate to the production zone. The wellbore traverses the underground formation. The method includes operating the magnetic source such that a continuous magnetic field is generated. Both the magnetized loose sand particle and the magnetized cemented sand particle within the continuous magnetic field experience a continuous repulsive magnetic force directed away from the wellbore. The continuous magnetic field penetrates through the production zone for a distance from the magnetic source. The continuous repulsive magnetic force is less than the mean cementation strength. The method includes producing the production fluid from the production zone to the wellbore at a production rate such that both the magnetized loose sand particle and the magnetized cemented sand particle experience a production fluid drag force directed towards the wellbore that is less than or equal to the continuous repulsive magnetic force. The method includes maintaining both the magnetic source and the production rate of the production fluid such that within the distance from the magnetic source that the production fluid drag force directed towards the wellbore that is less than or equal to the continuous repulsive magnetic force, such that the net difference between the continuous repulsive magnetic force and the production fluid drag force is in a range up to the mean cementation strength, such that the magnetized loose sand particle is not produced into the wellbore and such that the magnetized cemented sand particle is not converted into a magnetized loose sand particle.

A method for preventing the production and formation of loose sand particles from a production zone of an underground formation during production of a production fluid includes introducing a magnetic source into a wellbore such that the magnetic source is located proximate to the production zone. The wellbore traverses the underground formation. The method includes determining a mean cementation strength for the production zone, a first mean production fluid drag force at a first fluid production rate and a second mean production fluid drag force at a second fluid production rate from a sample of the production zone. The method includes operating the magnetic source such that a first continuous magnetic field is generated. Both a magnetized loose sand particle and a magnetized cemented sand particle within the first continuous magnetic field experience a first continuous repulsive magnetic force directed away from the wellbore. The first continuous magnetic field penetrates through the production zone for a first distance from the magnetic source. The first continuous repulsive magnetic force is less than the determined mean cementation strength. The first distance is up to five times the radius of the wellbore from the wellbore wall. The method includes producing the production fluid from the production zone to the wellbore at the first production rate. Both the magnetized loose sand particle and the magnetized cemented sand particle experience the first mean production fluid drag force directed towards the wellbore. The first mean production fluid drag force is less than the determined mean cementation strength. The method includes operating the magnetic source such that a second continuous magnetic field is generated such that both the magnetized loose sand particle and the magnetized cemented sand particle within the second continuous magnetic field experience a second continuous repulsive magnetic force directed away from the wellbore. The second continuous magnetic field penetrates the production zone for a second distance from the magnetic source. The second continuous repulsive magnetic force is greater than the determined mean cementation strength. The net difference between the second continuous repulsive magnetic force and the first production fluid drag force is in a range up to the determined mean cementation strength. The second distance is at least five times the radius of the wellbore from the wellbore wall. The method includes producing the production fluid from the production zone to the wellbore at the second production rate such that both the magnetized loose sand particle and the magnetized cemented sand particle experience the second mean production fluid drag force directed towards the wellbore that is greater than the determined mean cementation strength. The second production fluid drag force is less than or equal to the second continuous repulsive magnetic force. The net difference between the second continuous repulsive magnetic force and the second production fluid drag force is in a range up to the determined mean cementation strength.

The method prevents the production of loose sand from the production zone and the formation of additional loose sand during production by using the continuous magnetic field to generate a continuous repulsive magnetic force. The continuous repulsive magnetic force counteracts the effect of the production fluid drag force.

The counterforce to overcome the effects of the production fluid drag force is the continuous repulsive magnetic force that forms from the influence of the continuous magnetic field applied to the production zone. The continuous magnetic field originates from the magnetic source within the wellbore. The net effect of the opposing repulsive magnetic force away from the wellbore and the production fluid drag force towards the wellbore is that the mean cementation strength for the cemented sand particles is not overcome and new loose sand particles are not generated. The continuous magnetic field can be applied before ($t<t_0$), at the moment of production initiation ($t=t_0$) or after a production rate for the production fluid has been established that is less than the cementation strength ($t>t_0$). The continuous repulsive magnetic force is present for the distances in which the continuous magnetic field is present from the magnetic source.

The method includes magnetizing both loose sand particles and cemented sand particles. The loose and cemented sand particles are located within the underground formation in the production zone adjacent to the wellbore before production is initiated. After magnetizing the loose and cemented sand particles, the continuous magnetic field is able to influence the magnetized particles with the continuous repulsive magnetic force.

The production fluid is produced from the production zone of the underground formation while the continuous magnetic field is applied that penetrates the production zone. The magnetic source in the wellbore is operable to form the continuous magnetic field in the production zone such that a continuous repulsive magnetic force affects the magnetized particles within the production zone for a distance from the magnetic source. Optionally, the continuous magnetic field penetrates the production zone for a distance of at least about five times the radius of the wellbore from the wellbore wall. The magnetized loose and cemented sand particles experience the continuous repulsive magnetic force that is at least equal to if not greater than the production fluid drag force resulting from the movement into the wellbore of the production fluid. This balancing of the continuous repulsive magnetic force and the production fluid drag force not only causes the magnetized loose sand particles to remain in the production zone but also causes the magnetized cemented sand particles to remain cemented in the production zone.

The continuous magnetic field at different periods (before the initiation of production, the instance of production and during production) can be at different strengths to produce different continuous repulsive magnetic forces to counteract different levels of production fluid drag force. Where the production fluid drag force at the period of production ($t>t_0$)

is less than the cementation strength, the continuous magnetic field is maintained at a lower level relative to the strength the continuous magnetic field produced before or during initiation of production. The continuous magnetic field can be reduced during production such that that the magnetic field is discontinued. When the production fluid drag force is less than the mean cementation strength during production ($t>t_0$), the continuous repulsive magnetic force can be discontinued and the magnetic source removed from the wellbore. Where the production fluid drag force at the period of production ($t>t_0$) is greater than the mean cementation strength, the continuous magnetic field is maintained at a greater strength level compared to the level before or during the initiation of production. The produced continuous repulsive magnetic force the net force on the cemented sand particles from exceeding the mean cementation strength but also repels the loose sand particles to prevent both sand production and formation degradation.

Preventing sand production, especially at the initiation of production, permits the production fluid to contain little to no sand particles. This avoids long-term damage to downhole and surface rotating equipment as well as clogging of the completions string. Avoiding the formation of new loose sand particles acts to stabilize sensitive and unconsolidated formations that may have been previously damaged by the formation of the wellbore. Mitigating sand production also prevents sand from entering the wellbore, which may require intervention due to debris accumulation and the eventual choking off of sand prevention equipment. The method improves completions equipment operations and maintains overall production reliability.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

FIGS. 1-5 show the method for controlling sand particles. FIGS. 1-5 and its description facilitate a better understanding of the method for controlling sand particles. In no way should FIGS. 1-5 limit or define the scope of the invention. FIG. 1 is a simple diagram for ease of description.

DETAILED DESCRIPTION OF THE PREFERRED EMBODIMENTS

Figure 1:
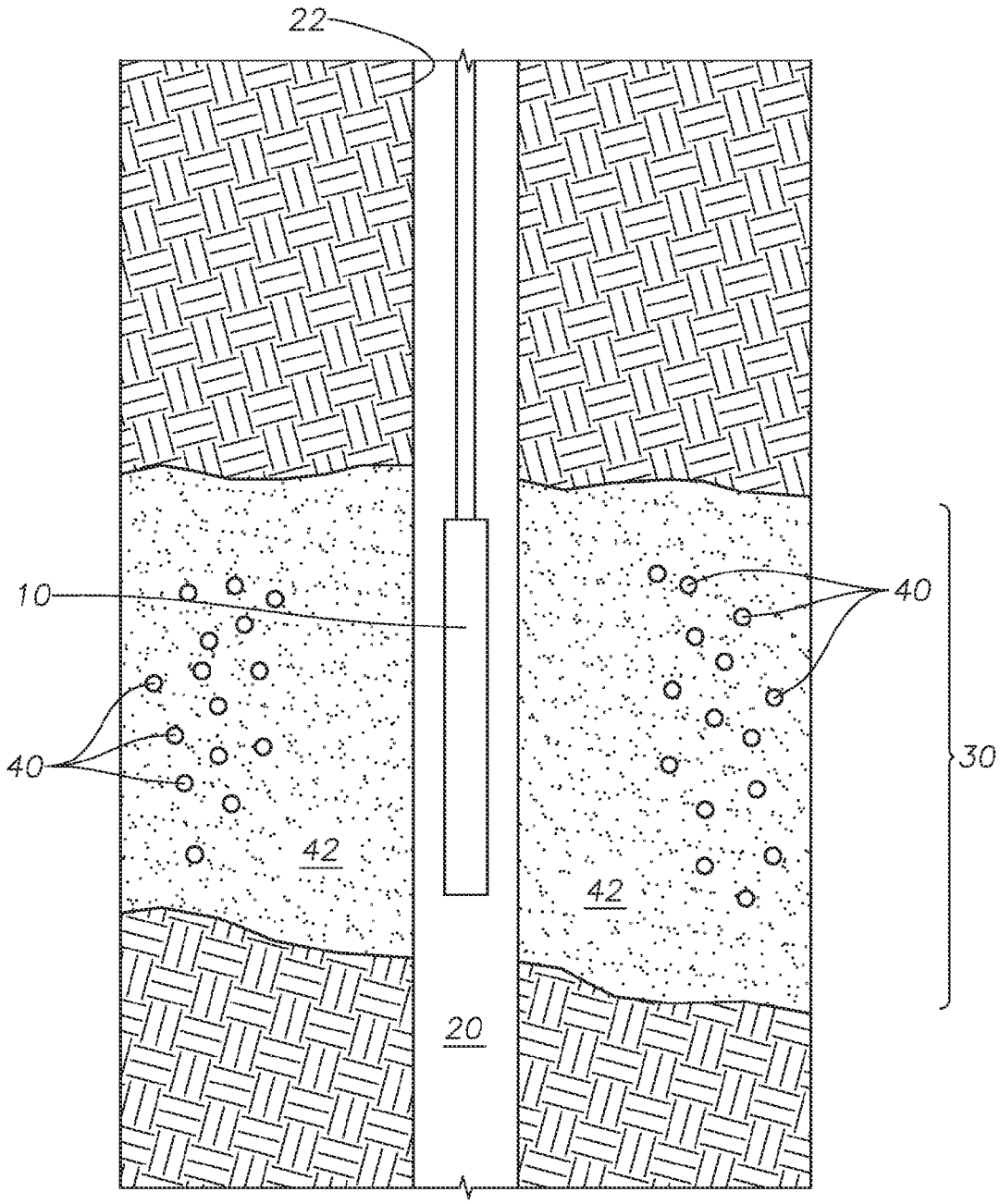
FIG. 1 shows a portion of an embodiment of the method for controlling sand particles from an underground formation during the production of hydrocarbons.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an" and "the" include plural references unless the context clearly indicates otherwise. The verb "comprises" and its conjugated forms should be interpreted as referring to elements, components or steps in a non-exclusive manner, and the invention illustrative disclosed suitably may be practiced in the absence of any element which is not specifically disclosed, including as "consisting essentially of" and "consisting of". The referenced elements, components or steps may be present, utilized or combined with other elements, components or steps not expressly referenced. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. "Associated" and its various forms means something connected with something else because they occur together or that one produces the other. "Detect" and its conjugated forms should be interpreted to mean the identification of the presence or existence of a characteristic or property. "Determine" and its conjugated forms should be interpreted to mean the ascertainment or establishment through analysis or calculation of a characteristic or property. "Maintain" and its conjugated forms should be interpreted to mean to carry on, continue, and to keep and retain in an existing or specified state.

Spatial terms describe the relative position of an object or a group of objects relative to another object or group of objects. The spatial relationships apply along vertical and horizontal axes. Orientation and relational words, including "uphole" and "downhole", are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

When a patent or a publication is referenced in this disclosure, the reference is incorporated by reference and in its entirety to the extent that it does not contradict statements made in this disclosure.

FIG. 1

FIG. 1 shows a portion of an embodiment of the method for controlling sand particles during production fluid production. The method includes introducing a magnetic source into a wellbore such that the magnetic source is located proximate to the production zone. In FIG. 1, magnetic source 10 has been introduced into wellbore 20, which is defined by wellbore wall 22, and positioned proximate to production zone 30 of the underground formation. There is no casing associated with wellbore wall 22.

Magnetized loose sand particles 40 and magnetized cemented sand particles 42 are repelled by the continuous repulsive magnetic force produced by the magnetic field emanating from magnetic source 10. Magnetized loose sand particles 40 within production zone 30 move with the production fluid flow under the influence of production fluid drag force. Magnetized cemented sand particles 42 are within production zone 30 but do not move with the production fluid flow. Magnetized cemented sand particles 42 are attached to production zone 30 with a mean cementation strength. The polarity of magnetic source 10, magnetized loose sand particles 40, and magnetized cemented sand particles 42 are the same such that both magnetized loose sand particles 40 and magnetized cemented sand particles 42 experience a continuous repulsive magnetic force from the direction of magnetic source 10 during the generation of the continuous magnetic field.

The continuous repulsive magnetic force originates from the field generated by a magnetic source, including an electromagnet introduced into the wellbore or by using an induced metal such as a section of casing. The magnetic source is located in the wellbore proximate to the production zone. The magnetic source can be hung as a liner and powered in a similar fashion as a submersible pump or it can have a local power source such as a fluid turbine or a battery pack for periodic use. Optionally, the magnetic force is applied during production of the production fluid.

FIG. 2

In an embodiment of the method, the magnetic source comprises a casing for the wellbore. The casing contacts the wellbore wall of the wellbore and is operable to permit fluid communication of the production fluid from the production zone into the wellbore. In an embodiment of the method, perforations are formed in the casing such that the casing is operable to permit fluid communication of the production fluid from the production zone into the wellbore.

Figure 2A:
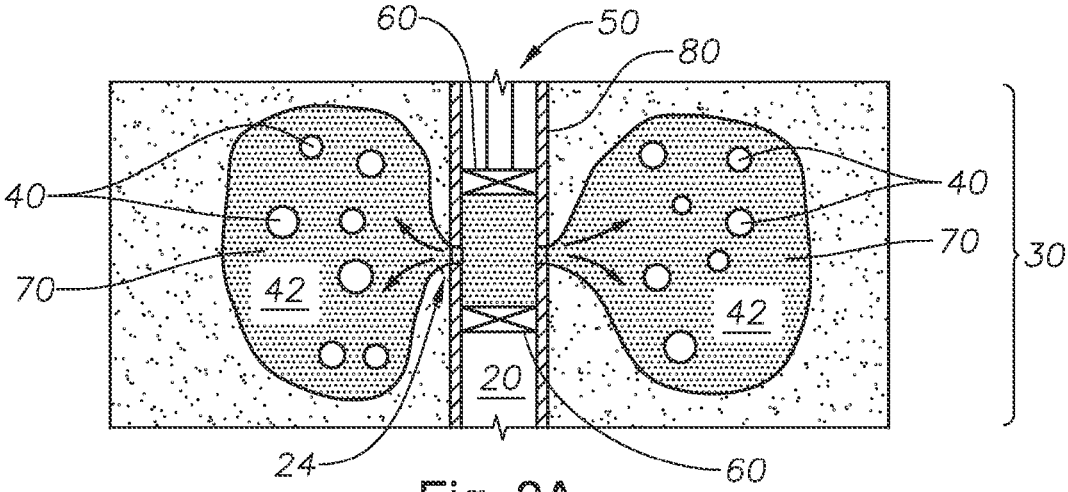
FIG. 2A shows a portion of another embodiment of the method for controlling sand particles.

FIG. 2A shows a portion of another embodiment of the method for controlling sand particles during production. In FIG. 2A, casing 80 connects to wellbore wall 22 and has perforation 24 such that fluid communication occurs between wellbore 20 and production zone 30. Coiled tubing 50 and packers 60 are installed in wellbore 20 to direct magnetizing fluid 70 towards perforation 24. Magnetizing fluid 70 is introduced into production zone 30 the underground formation such that both loose and cemented sand particles are contacted with magnetizing fluid 70, forming magnetized loose sand particles 40 and magnetized cemented sand particles 42, respectively.

As noted previously during formation of the wellbore, the tangential stresses are greater in the areas of the underground formation proximate to the wellbore. This results in the formation of loose sand particles proximate the wellbore. In an embodiment of the method, the magnetizing fluid is introduced into the production zone such that it permeates the production zone a distance of up to about five times the radius of the wellbore from the wellbore wall. Five times the radius of the wellbore is the expected analytical solution (also called the Kirsch solution) related to the stress around the wellbore and the permeation of loose sand particles. The magnetized loose sand particles within this area are magnetized and experience repulsion upon introduction of the magnetic field into the production zone. The magnetized cemented sand particles within this area also experience the repulsion force upon application of the magnetic field, which counteracts at least in part the production drag force directed towards the wellbore. The net effect of the counterforces is that the formation of new loose sand particles is prevented and the loose sand particles already present are not produced.

Figure 2B:
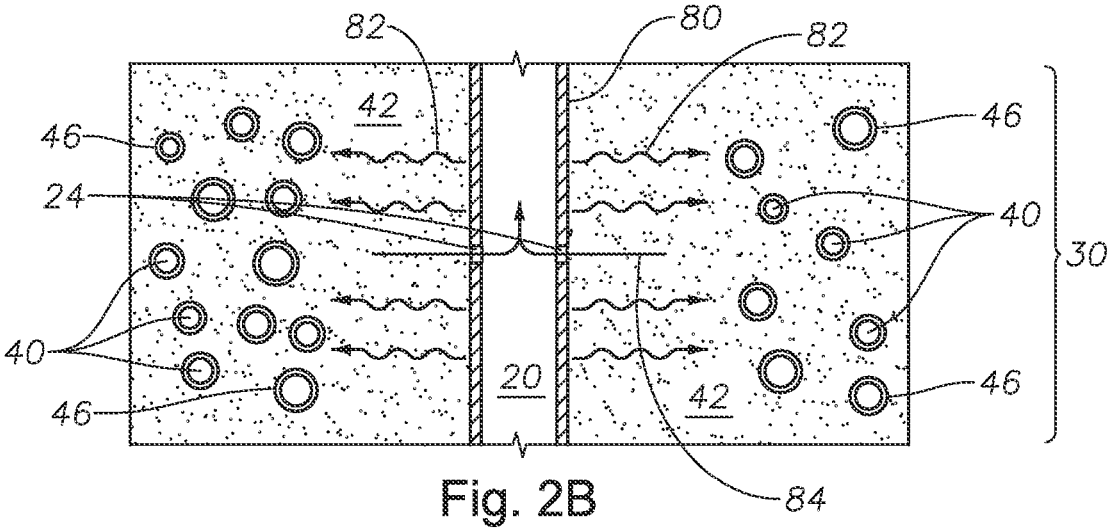
FIG. 2B shows another portion of the embodiment of the method for controlling sand particles.

FIG. 2B shows another portion of the embodiment of the method for controlling sand particles during hydrocarbon production using casing. Casing 80 is generating a continuous magnetic field (not shown for clarity). Casing 80 is made of a metal such as steel. Casing 80 is either directly magnetized through known methods such as induced magnetism or is made into an electromagnetic by passing an electrical current through casing 80. The generated magnetic field penetrates production zone 30 of the underground formation for a distance from wellbore 20. Magnetized loose sand particles 40, which include magnetic coating 46, and magnetized cemented sand particles 42 (magnetic coating 46 present but not shown for clarity) within the continuous magnetic field experience continuous repulsive magnetic force (wavy arrows 82) directed away from wellbore 20. Production fluid is produced (arrows 84) through perforation 24 into wellbore 20.

Magnetized loose sand particles 40 and magnetized cemented sand particles 42 are both contacted with magnetizing fluid 70 and coated with magnetic coating 46. In an embodiment of the method, magnetic coating 46 includes a plurality of paramagnetic nanoparticles. In an embodiment of the method where the loose sand particles and the cemented sand particles contain silica, magnetic coating 46 forms by contacting the loose and cemented sand particles with the magnetizing fluid 70 having water and particles of the magnetic material.

In an embodiment of the method, the step of converting the loose and cemented sand particles into magnetized loose and cemented sand particles occurs prior to forming perforations in the casing.

FIG. 3

Figure 3:
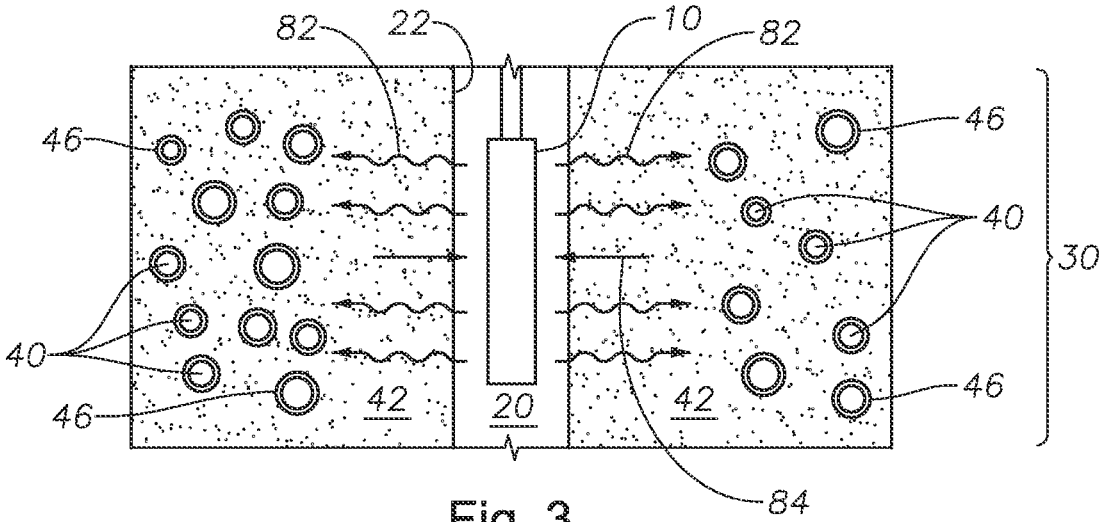
FIG. 3 shows a portion of an embodiment of the method for controlling sand particles during hydrocarbon production for an open hole.

FIG. 3 shows a portion of an embodiment of the method for controlling sand particles during hydrocarbon production for an open hole. FIG. 3 shows an embodiment of a method where the completion is open hole and there is no casing 80 associated with wellbore wall 22 in production zone 30 of the wellbore 20. In this embodiment of the method, magnetic source 10 is located downhole of the production tubing (not shown). Magnetic source 10 is introduced into wellbore 20 downhole of the production tubing (not shown) and facing the open hole production zone 30 of underground formation. Magnetic source 10 is demagnetized during introduction and removal from wellbore 20.

Figure 5:
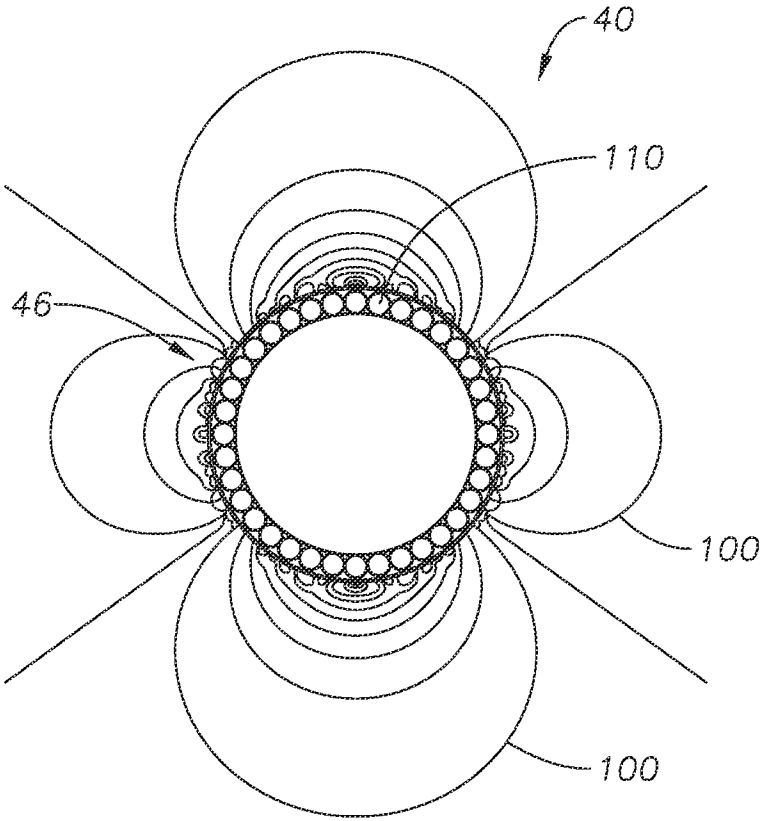
FIG. 5 shows a demonstrative microscopic view of a contour plot surrounding an individual magnetized loose sand particle at a second surface concentration.
Figure 4:
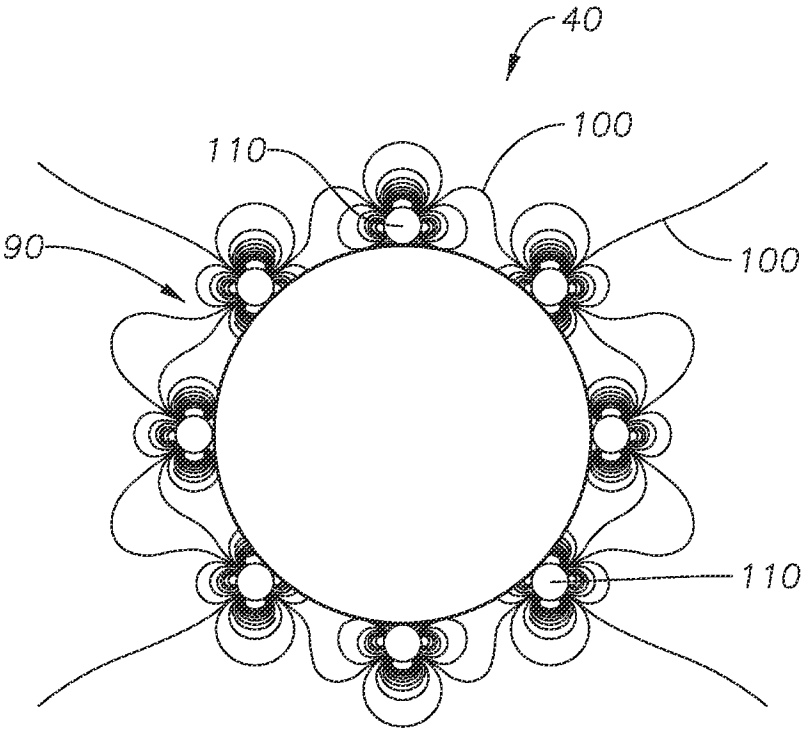
FIG. 4 shows a demonstrative microscopic view of a contour plot surrounding an individual magnetized loose sand particle at a first surface concentration.

FIGS. 4 and 5

FIG. 4 shows a demonstrative microscopic view of a contour plot surrounding an individual magnetized loose sand particle at a first surface concentration of magnetizing particles. Contour plot 100 shows the results from the attachment of paramagnetic particles 110 to the outer surface of magnetized loose sand particles 40. FIG. 5 shows a demonstrative microscopic view of a contour plot surrounding an individual magnetized loose sand particle at a second surface concentration of magnetizing particles. Magnetized loose sand particles 40 have a greater surface concentration of paramagnetic particles 110, thereby creating contour plot 100 that is strong than contour plot 100 of magnetized loose sand particles 40 of FIG. 4. In FIG. 5, magnetic coating 46 acts like a shell around magnetize loose sand particles 40.

Preflushing Fluid

An embodiment of the method includes introducing a pretreatment surfactant into the production zone for a distance from the magnetic source prior to converting both the loose and the cemented sand particles such that the production fluid for the distance from the magnetic source is displaced. In a further embodiment of the method, the distance is up to five times the radius of the wellbore from the wellbore wall. In a further embodiment of the method, the distance is at least five times the radius of the wellbore from the wellbore wall.

Preflushing the production zone with a preflushing fluid, which includes a pretreatment surfactant, assists in driving brine or formation water and hydrocarbons, which is part of the production fluid, away from the wellbore and manipulates the surface characteristics of both the loose and cemented sand particles such that the sand particles are prepared for coating by the magnetizing reagent or fluid. The preflushing fluid improves surface adhesion for the magnetizing reagent or fluid versus without preflushing by removing water, salts and organic chemicals from the surface of the sand particles.

In an embodiment of the method, the preflushing fluid displaces the fluid in the production zone. The displacement occurs near the wellbore in the pore space of the production zone. In some embodiments of the method, the preflushing fluid includes a mutual solvent. Mutual solvents are miscible in brine or formation water and hydrocarbons simultaneously at downhole conditions. Glycol ethers are mutual solvents. The mutual solvent is operable to improve the liquid-contacting surfaces (the outer surface of the loose and cemented sand particles) of the production zone such that the magnetizing reagents or fluids adhere to the outer surfaces of the particles. In an embodiment of the method, the preflushing fluid includes a sodium carbonate solution.

In an embodiment of the method, the method includes preflushing before converting the sand particles into magnetized sand particles. In an embodiment of the method, the preflushing fluid is operable to impart a negative charge on the outer surface of the loose and cemented sand particles. In such an embodiment, the production zone is flushed with the mutual solvent such that the formation water or brine and hydrocarbons are miscibly displaced in a range of from about two to about three feet away from the wellbore wall of the wellbore, forming a zone deficient in water and hydrocarbons. In another embodiment of the method, the formation water or brine and hydrocarbons are miscibly displaced up to about five times the radius of the wellbore away from the wellbore wall. In another embodiment of the method, the formation water or brine and hydrocarbons are miscibly displaced more than about five times the radius of the wellbore away from the wellbore wall.

The amount of preflushing fluid is a function of the formation pore volume and the depth of the pretreatment interval within the production zone. The effectiveness of preflushing is improved with additional time exposure to the treated production zone. In an embodiment of the method, the preflushing fluid is introduced into the production zone and maintained for at least two hours in the portion of the treated production zone. Mutual solvent introduction can be performed by bullheading the solvent downhole or by directing the mutual solvent through coil tubing (a coiled tubing unit or CTU). The mutual solvent is at least partially recoverable upon the initiation of production.

In another embodiment of the method and after the formation has been treated with the preflushing fluid, the hydrocarbon-bearing formation can be "shut in" or maintained for a period of at least two hours following introduction of the magnetizing fluids or reagents. This maintenance period of this embodiment of the method permits the magnetizing fluids or reagents to adhere to the previously preflushed loose and cemented sand particles within the treatment area and form a proper magnetized coating for future continuous repulsive magnetic force application.

Determination of Production Fluid Drag Force and Mean Cementation Strength

An embodiment of the method includes determining the mean cementation strength for the cemented sand particles using a sample of the production zone. Mean cementation strength is the strength of adhesion of particles to one another and to the formation. An embodiment of the method includes determining the production fluid drag force at the production rate using the sample of the production zone.

The sample from the production zone can be obtained during the formation of the wellbore from the drilling fluid returns. The sample can also be obtained by core sampling the production zone after formation of the wellbore. The sample can provide detectable and determinable information regarding the production zone, including average pore size and the pore size distribution, production zone pore connectivity, overall pore volume per unit of production zone, the type and distribution of hydrocarbons present in the production zone for selection of a mutual solvent and the mean cementation strength for the cemented sand particles.

Determining or at least reliability estimating mean cementation strength for the production zone can be accomplished through known destructive mechanical testing on samples of the production zone. The magnetic repulsive force used to keep the cemented sand particles attached to the production zone can be determined using core or returns samples from the production zone. The mean cementation strength is measured against a compressive or tensile load (stress). The sample is tested under a loading frame (for inducing formation stress) using the same temperature and pressure conditions to determine the rate of breakdown of the sand particles within the core sample. Cohesion strength is proportional to cementation or even compressive strength. From such testing, the mean cementation strength of the sand particles within the sample and therefore for the production zone is determined. This provides information useful to prevent the fluid production rate from being great enough such that the drag force exceeds the cementation strength. In addition, it also indicates the maximum amount of repulsive magnetic force applied before production has been initiated such that the magnetic source does not generate loose magnetized sand particles from cemented magnetized sand particles.

The mean cementation strength can also be inferred while determining the production fluid drag force at fluid production rates through the sample. To determine the production fluid drag force within the production zone at each of several fluid production rates from the production zone, a core sample of the production zone is tested under a loading frame (for inducing formation stress) using the same temperature and pressure conditions as the formation to observe fluid production rate and the degree of sand production that occurs at a given production rate. Gradually increasing the production fluid flow value through the core sample gives a range of production fluid drag force values that are useful for determining the appropriate repulsive counter-force for mitigation of fluid flow stresses at a given production rate. The increasing production fluid flows through the core sample also indicate the amount and level of sand production at a given fluid flow rate without magnetic treatment of the production zone. The continuous repulsive magnetic force formed by the continuous magnetic field prevents loose sand production of sand particles that are magnetized as well as the formation of new loose magnetized sand particles from formerly magnetized cemented sand particles. In an embodiment of the method, the production fluid drag force is determined using information obtained from a sample of the production zone and the detected production rate of the production fluid, field horizontal stresses and reservoir pressure.

By testing such samples for the mean cementation strength and a range of production fluid drag forces as a function of production fluid flow rate, an adequate range of continuous repulsive magnetic force values at a given production rate can be provided to determine suitable production fluid flow rate and energy consumption by the magnetic source.

In an embodiment of the method includes detecting the amount of loose sand particles produced with the hydrocarbon fluid and adjusting the continuous magnetic field from a first value to a second value such that the amount of loose sand particles produced is reduced to a non-detectable amount.

Converting Sand Particles into Magnetized Sand Particles

The method for preventing the production and formation of loose sand particles from the production zone includes converting the loose and the cemented sand particles in the production zone into the magnetized loose and the magnetized cemented sand particles, respectively. The production zone includes loose and cemented sand particles along with the production fluid.

In an embodiment of the method, the loose sand particles and the cemented sand particles within the production zone of the hydrocarbon-bearing formation are magnetized by exposing them to an electromagnetic field before initiating production. In such cases, the loose and cemented sand particles are ferromagnetic. Where loose and cemented sand particles contain ferromagnetic materials, including iron oxides such as $Fe_3O_4$, the loose and cemented sand particles are optionally magnetized through direct magnetization. Direct magnetization includes allowing the ferromagnetic material to pick up magnetism by inducing magnetism through an externally-provided electromagnetic field. A technique for producing a strong externally-provided magnetic field is to use a capacitor with a solenoid. The strong magnetic field causes the ferromagnetic sand particles to become magnetized. Magnetized ferromagnetic sand particles can retain their field and adhere to one another magnetically even in the absence of the applied magnetic field once induced. Larger sand particles comprised of smaller magnetized ferromagnetic sand particles are limited in their mobility through the production zone. The size of the aggregated particles may exceed the pore size of the production zone.

In an embodiment of the method, converting the loose and the cemented sand particles includes introducing the magnetizing fluids into the production zone such that the magnetizing fluids contacts both, forming the magnetized loose and cemented sand particles. In an embodiment of the method, converting the loose and the cemented sand particles includes introducing a reagent comprising paramagnetic nanoparticles into the production zone such that the reagent contacts both the loose and the cemented sand particles, forming the magnetized loose and the magnetized cemented sand particles, respectively. In an embodiment of the method, converting the loose and the cemented sand occurs prior to introducing the magnetic source into the wellbore.

Magnetizing fluids includes magnetizing reagents, ferrofluids, paramagnetic nanoparticles, ferromagnetic particles and combinations thereof. Magnetizing the loose and cemented sand particles can include isolating a section of the wellbore using packers and bullheading the magnetic fluid into the isolated section of the wellbore. Coiled tubing can be used to convey the magnetic fluid into the isolated section of the wellbore. The magnetic fluid is introduced into the production zone of the underground formation to a distance of at least five times the radius of the wellbore from the wellbore wall. The continuous magnetic field penetrates the production zone for a distance of at least about five times the radius of the wellbore from the wellbore wall to generate the continuous repulsive magnetic force over the interval. When the continuous magnetic field is introduced, the continuous repulsive magnetic force acts on the magnetized loose and cemented sand particles for a distance of at least five times the radius of the wellbore from the wellbore wall.

Magnetization can be achieved by contacting the outer surface of the loose and cemented sand particles with the magnetizing fluids or reagents to coat the loose and cemented sand particles to create magnetized loose and cemented sand particles. In an embodiment of the method, the magnetizing fluids comprises paramagnetic nanoparticles suspended in a carrier fluid. The paramagnetic nanoparticles include ferric ions, magnetite ions, hematite ions and maghemite ions. Paramagnetic nanoparticles are suspended in a carrier fluid that comprises an organic solvent, water or both. Such magnetizing fluids are described in U.S. Pat. No. 4,834,898 (Hwang; issued May 30, 1989). This method of magnetizing the loose and cemented sand particles is particularly useful when the particles are not naturally ferromagnetic.

Paramagnetic particles are particles having a small yet positive susceptibility to a magnetic field. Paramagnetic materials in general are modestly affected by an external magnetic field, and the paramagnetic material does not retain its magnetic polarity when the magnetic field is removed. The paramagnetic properties are due to the presence of unpaired electrons, and their realignment of the electron orbit is caused by the presence of the external magnetic field.

In an embodiment of the method, the magnetizing fluids include a magnetizing reagent that includes water and particles of a magnetic material. Non-magnetic loose and cemented sand particles, particularly those having silica, are rendered magnetic by contacting the surface of the particle with the magnetizing reagent, which comprising water and magnetic particles.

In an embodiment of the method, the magnetic particles have a two layer surfactant coating that includes an inner layer and an outer layer. The inner layer covers the magnetic particle and can be a monomolecular layer of a first water soluble, organic heteropolar surfactant containing at least three carbon atoms. The inner monomolecular layer has a functional group on one end which bonds with the magnetic particle. The outer layer coats the inner layer and can be a monomolecular layer of a second water soluble, organic heteropolar surfactant containing at least three carbon atoms. The outer monomolecular layer has a hydrophobic end bonded to the hydrophobic end of the first surfactant and a functional group on the other end operable to bond with the loose or cemented sand particle to be magnetized. Hwang discloses such magnetizing reagents.

Ferrofluids contain ferromagnetic particles that have diameters that are larger than about 20 nanometers (nm), whereas paramagnetic or super-paramagnetic particles have diameters less than about 20 nm. In an embodiment of the method, the ferromagnetic particles have a diameter of about 50 nm.

Ferromagnetic particles are those that have a large and positive susceptibility to an external magnetic field. Ferromagnetic particles are strongly affected by an applied magnetic field and are able to retain their polarity after the magnetic field has been removed. Ferromagnetic materials have unpaired electrons such that the atoms have a net magnetic moment. Ferromagnetic materials have a strong magnetic property due to the presence of magnetic domains. In the domains, large numbers of the moments of an atom (1012 to 1015) are aligned parallel so that the magnetic force within the domain is strong. When a ferromagnetic material is in the unmagnetized state, the domains are randomly organized and the net magnetic field for the part as a whole is zero. When a magnetizing field is applied, the domains become aligned in reaction to the magnetic field.

In an embodiment of the method, iron oxide particles that are covered with a neutrally-charged coating (a polymer) or a positively charged iron oxide particle is part of the magnetizing fluids. The iron oxide particles adhere to the sand surfaces and then polarize the particles in a magnetic field. The polarization of the particles causes the magnetized sand particles to stick together, which limits sand production as particle size increases.

In an embodiment of the method where casing is introduced as the magnetic source, converting the loose and the cemented sand particles into the magnetized loose and the cemented sand particles occurs before perforating the casing. The casing can be used to generate the electromagnetic field that magnetizes ferromagnetic particles within the hydrocarbon-bearing formation before perforating the casing proximate to the hydrocarbon-bearing formation. In situations where the magnetizing fluids or reagents having paramagnetic nanoparticles are introduced into the production zone, the fluid can be introduced into the uncased or bare hole and then the casing installed afterwards.

Balancing Continuous Repulsive Magnetic Force and Production Fluid Drag Force

The method includes operating the magnetic source such that a continuous magnetic field is generated. The continuous magnetic field generated by the magnetic source penetrates through the production zone for a distance from the magnetic source. The continuous repulsive magnetic force is less than the mean cementation strength for a period before, during initiation of production and shortly after production starts to prevent the magnetic force from exceeding the determined mean cementation strength given the lack of or minimal production fluid drag force. The loose magnetized sand particles in this stagnant or low-flow environment are influenced to migrate away from the wellbore.

In an embodiment of the method, before producing the production fluid from the production zone, the magnetic source is operated such that the magnetized loose and cemented sand particles that are within the production zone are penetrated by the continuous magnetic field and the magnetized particles experience the continuous repulsive magnetic force that is directed away from the wellbore.

In an embodiment of the method, the continuous magnetic field is generated for a distance up to five times the radius of the wellbore from the wellbore wall.

The method includes producing the production fluid from the production zone to the wellbore at a production rate. The magnetized loose and cemented sand particles experience a mean production fluid drag force within the production zone. The mean production fluid drag force is directed towards the wellbore because of the production of the production fluid.

In an embodiment of the method, the mean production fluid drag force is less than the determined mean cementation strength. Limiting the production fluid flow rate such that the mean production fluid drag force does not exceed the determined mean cementation strength at or after the initiation of production but before the operation of the magnetic source to produce the continuous magnetic field prevents exceeding the cementation strength of the magnetized cemented sand particles. Although loose sand particles may move towards the wellbore in such a situation, the cemented sand particles are not freed from their adhesion to each other or the production zone.

The method includes where production fluid drag force is less than or equal to the continuous repulsive magnetic force. Operation of the magnetic source and the production rate of the production fluid such that within the distance from the magnetic source the production fluid drag force that is less than or equal to the continuous repulsive magnetic force. Not only does this prevent the magnetized loose sand particles from being produced into the wellbore, but it also prevents the conversion of the magnetized cemented sand particles are not converted into magnetized loose sand particles.

The net difference between the continuous repulsive magnetic force and the production fluid drag force is in a range up to the determined mean cementation strength. During the method, the net difference between the continuous repulsive magnetic force and the production fluid drag force is in a range up to the mean cementation strength. The net difference is an absolute value. If the mean cementation strength is exceeded in either direction (towards, away from the wellbore), the magnetized cemented sand particles will begin to detach from one another and from the production zone, forming magnetized loose sand particles. Since the continuous repulsive magnetic force and the production fluid drag force are in opposing direction, the net effect on the magnetized loose and cementation sand particles is the difference between the two opposing forces.

In an embodiment of the method, the continuous repulsive magnetic force and the production fluid drag force each exceed the determined mean cementation strength. As production of production fluid increases, the production fluid drag force exceeds the determined mean cementation strength for a given production rate. To counter the production fluid drag force that exceeds the cementation strength, the magnetic source is operated such that a continuous repulsive magnetic force that is also greater than the determined mean cementation strength is applied to the magnetized loose and cemented sand particles. The net difference between the continuous repulsive magnetic force and the production fluid drag force at the elevated production rate is in a range up to the determined mean cementation strength. Even though both independent forces exceed the cementation strength, because both forces negate one another the magnetized loose sand particles are not produced and the magnetized cemented sand particles are maintained.

In an embodiment of the method, the continuous magnetic field penetrates the formation for distance is at least five times the radius of the wellbore from the wellbore wall. In instances where both the continuous repulsive magnetic force and the production fluid drag force exceed the cementation strength, the continuous magnetic field may extend beyond the area of the production zone where the continuous repulsive magnetic force did not exceed the cementation strength. In such cases, loose sand particles are pushed deeper into the hydrocarbon-bearing formation, leaving fluid flow channels closer to the wellbore more open to production fluid flow.

What is claimed is:

1. A method for preventing production and formation of a loose sand particle from a production zone of an underground formation during production of a production fluid, the method comprising the steps of:

converting in the production zone both the loose sand particle into a magnetized loose sand particle and a cemented sand particle into a magnetized cemented sand particle, where the production zone comprises the loose sand particle, the cemented sand particle and the production fluid, and where the cemented sand particle has a mean cementation strength to the production zone;

introducing a magnetic source into a wellbore such that the magnetic source is located proximate to the production zone, where the wellbore traverses the underground formation;

operating the magnetic source such that a continuous magnetic field is generated such that both the magnetized loose sand particle and the magnetized cemented sand particle within the continuous magnetic field experience a continuous repulsive magnetic force directed away from the wellbore, where the continuous magnetic field penetrates through the production zone for a distance from the magnetic source and where the continuous repulsive magnetic force is less than the mean cementation strength;

producing the production fluid from the production zone to the wellbore at a production rate such that both the magnetized loose sand particle and the magnetized cemented sand particle experience a production fluid drag force directed towards the wellbore that is less than or equal to the continuous repulsive magnetic force; and maintaining both the magnetic source and the production rate of the production fluid such that within the distance from the magnetic source the production fluid drag force is less than or equal to the continuous repulsive magnetic force, such that the net difference between the continuous repulsive magnetic force and the production fluid drag force is in a range up to the mean cementation strength, such that the magnetized loose sand particle is not produced into the wellbore and such that the magnetized cemented sand particle is not converted into a magnetized loose sand particle.

2. The method of claim 1 where the step of maintaining the magnetic source and the production rate of the production fluid is such that both the continuous repulsive magnetic force and the production fluid drag force each exceed the determined mean cementation strength.

3. The method of claim 1 where the step of converting comprises magnetizing the loose sand particle and the cemented sand particle by exposing the loose sand particle and the cemented sand particle to an electromagnetic field such that the magnetized loose sand particle and the magnetized cemented sand particle form, where the loose sand particle and the cemented sand particle are both ferromagnetic.

4. The method of claim 1 where the step of converting comprises introducing a magnetizing fluid into the production zone such that the magnetizing fluid contacts both the loose sand particle and the cemented sand particle, forming the magnetized loose sand particle and the magnetized cemented sand particle, respectively.

5. The method of claim 1 where the step of converting comprises introducing a reagent comprising paramagnetic nanoparticles into the production zone such that the reagent contacts both the loose sand particle and the cemented sand particle, forming the magnetized loose sand particle and the magnetized cemented sand particle, respectively.

6. The method of claim 1 further comprising the step of introducing a pretreatment surfactant into the production zone for the distance from the magnetic source prior to the step of converting both the loose and the cemented sand particle such that the production fluid for the distance from the magnetic source is displaced.

7. The method of claim 1 where the magnetic source comprises a casing for the wellbore, where the casing contacts a wellbore wall of the wellbore and is operable to permit fluid communication of the production fluid from the production zone into the wellbore.

8. The method of claim 1 where the continuous magnetic field penetrates the production zone for a distance of at least about five times the radius of the wellbore from the wellbore wall.

9. The method of claim 1 further comprising the step of determining the mean cementation strength for the cemented sand particle using a sample of the production zone.

10. The method of claim 1 further comprising the step of determining the production fluid drag force at the production rate using a sample of the production zone.

11. A method for preventing production and formation of a loose sand particle from a production zone of an underground formation during production of a production fluid, the method comprising the steps of:

introducing a magnetic source into a wellbore such that the magnetic source is located proximate to the production zone, where the wellbore traverses the underground formation;

determining a mean cementation strength for the production zone, a first mean production fluid drag force at a first fluid production rate and a second mean production fluid drag force at a second fluid production rate using a sample of the production zone;

operating the magnetic source such that a first continuous magnetic field is generated such that both a magnetized loose sand particle and a magnetized cemented sand particle within the first continuous magnetic field experience a first continuous repulsive magnetic force directed away from the wellbore and such that the first continuous magnetic field penetrates the production zone for a first distance from the magnetic source, where the first continuous repulsive magnetic force is less than the determined mean cementation strength and where the first distance is up to five times the radius of the wellbore from the wellbore wall;

producing the production fluid from the production zone to the wellbore at the first production rate such that both the magnetized loose sand particle and the magnetized cemented sand particle experience the first mean production fluid drag force directed towards the wellbore, where the first mean production fluid drag force is less than the determined mean cementation strength;

operating the magnetic source such that a second continuous magnetic field is generated such that both the magnetized loose sand particle and the magnetized cemented sand particle within the second continuous magnetic field experience a second continuous repulsive magnetic force directed away from the wellbore and such that the second continuous magnetic field penetrates the production zone for a second distance from the magnetic source, where the second continuous repulsive magnetic force is greater than the determined mean cementation strength, where the net difference between the second continuous repulsive magnetic force and the first production fluid drag force is in a range up to the determined mean cementation strength, and where the second distance is at least five times the radius of the wellbore from the wellbore wall; and producing the production fluid from the production zone to the wellbore at the second production rate such that both the magnetized loose sand particle and the magnetized cemented sand particle experience the second mean production fluid drag force directed towards the wellbore that is greater than the determined mean cementation strength, where the second production fluid drag force is less than or equal to second continuous repulsive magnetic force, and where the net difference between the second continuous repulsive magnetic force and the second production fluid drag force is in a range up to the determined mean cementation strength.

12. The method of claim 11 where the first mean production fluid drag force is less than or equal to the first continuous repulsive magnetic force.

13. The method of claim 12 further comprising the step of converting in the production zone both a loose sand particle into the magnetized loose sand particle and a cemented sand particle into the magnetized cemented sand particle, where the production zone comprises the loose sand particle, the cemented sand particle and the production fluid.

14. The method of claim 13 where the step of converting in the production zone occurs prior to the step of introducing the magnetic source into the wellbore.

15. The method of claim 13 further comprising the step of introducing a pretreatment surfactant into the production zone for the first distance from the magnetic source prior to the step of converting both the loose and the cemented sand particle such that the production fluid for the first distance from the magnetic source is displaced.

16. The method of claim 13 further comprising the step of introducing a pretreatment surfactant into the production zone for the second distance from the magnetic source prior to the step of converting both the loose and the cemented sand particle such that the production fluid for the second distance from the magnetic source is displaced.

17. The method of claim 13 where the magnetic source introduced comprises a casing for the wellbore, where the casing contacts a wellbore wall of the wellbore.

18. The method of claim 17 further comprising the step of forming a perforation in the casing such that the casing is operable to permit fluid communication of the production fluid from the production zone into the wellbore.

19. The method of claim 18 where the step of converting in the production zone occurs prior to the step of forming the perforation in the casing.

20. The method of claim 11 where the step of operating the magnetic source such that a first continuous magnetic field is generated occurs prior to the step of producing the production fluid from the production zone to the wellbore at the first production rate.

* * * * *